US007458530B2

(12) United States Patent
Morton

(10) Patent No.: US 7,458,530 B2
(45) Date of Patent: Dec. 2, 2008

(54) FUEL INJECTOR SLEEVE ARMATURE

(75) Inventor: Greg R. Morton, Yorktown, VA (US)

(73) Assignee: Continental Automotive Systems US, Inc., Auburn Hills ( * ) Notice: Subject to any disclaimer, the term of this patent is extended or adjusted under 35 U.S.C. 154(b) by 898 days.

(21) Appl. No.: 10/806,464

(22) Filed: Mar. 23, 2004

(65) Prior Publication Data

US 2005/0023383 A1 Feb. 3, 2005

Related U.S. Application Data

(63) Continuation-in-part of application No. 09/970,677, filed on Oct. 5, 2001, now abandoned.

(51) Int. Cl.
*F02M 51/00* (2006.01)

(52) U.S. Cl. ..... 239/585.5; 239/900

(58) Field of Classification Search ... 239/585.1–585.5, 239/900

See application file for complete search history.

(56) References Cited

U.S. PATENT DOCUMENTS 4,483,485 A 11/1984 Kamiya et al.
4,610,080 A 9/1986 Hensley
4,662,567 A 5/1987 Knapp
4,946,132 A 8/1990 Reiter
5,769,328 A 6/1998 Zdyb et al.
5,875,975 A 3/1999 Reiter et al.
6,045,116 A 4/2000 Willke et al.
6,062,499 A 5/2000 Nakamura et al.
6,076,802 A 6/2000 Maier
6,409,101 B1 * 6/2002 D'Arrigo ..... 239/585.1
6,499,669 B2 12/2002 Ganser
6,523,756 B2 2/2003 Dallmeyer et al.
6,543,707 B2 4/2003 Dallmeyer et al.
6,565,019 B2 5/2003 Dallmeyer et al.
6,607,143 B2 8/2003 Dallmeyer et al.
6,676,044 B2 1/2004 Dallmeyer et al.
6,708,906 B2 * 3/2004 Dallmeyer et al. ..... 239/585.1

* cited by examiner

*Primary Examiner*—Christopher S Kim

(57) ABSTRACT

A fuel injector having a housing including an inlet, an outlet, and a passageway for fuel flow from the inlet to the outlet. A coil assembly is disposed proximate the inlet. A seat is disposed proximate the outlet. A closure member is disposed in the housing and is operable by the coil assembly. The closure member includes a sleeve and an armature. The sleeve extends along a longitudinal axis and includes first and second ends, and an outer surface a first distance from the longitudinal axis. An armature is coupled to the first end of the sleeve so that the sleeve is movable with the armature. The armature includes an outer perimeter a second distance from the longitudinal axis, such that the second distance is not greater than the first distance.

14 Claims, 5 Drawing Sheets

FUEL INJECTOR SLEEVE ARMATURE

This application is a continuation-in-part of U.S. patent application Ser. No. 09/970,677 filed Oct. 5, 2001, now abandoned, the entirety of which is incorporated by reference.

FIELD OF INVENTION

The invention relates to a closure member for a fuel injector, and more particularly to a closure member that defines a radial working gap between the exterior surface of an armature and the interior surface of an actuator.

BACKGROUND OF THE INVENTION

It is known to use a variety of sealing mechanisms to permit and inhibit fuel flow through fuel injectors. These mechanisms include needle and armature, ball and armature, and ball and disk combinations. It is believed that a radial working gap between the armature and the coil of the fuel injector must be set to enhance the magnetic properties of the injector. It is known to use a variety of processes on the outer diameter of the armature to determine the working gap, including chroming, separate machining operations, and eyelet crimping. These processes suffer from disadvantages including additional manufacturing steps, added components, and increased costs.

SUMMARY OF THE INVENTION

In an embodiment, the invention provides a fuel injector having a housing including an inlet, an outlet, and a passageway for fuel flow from the inlet to the outlet. A coil assembly is disposed proximate the inlet. A seat is disposed proximate the outlet. A closure member is disposed in the housing and is operable by the coil assembly. The closure member includes a sleeve and an armature. The sleeve extends along a longitudinal axis and includes first and second ends, and an outer surface a first distance from the longitudinal axis. An armature is coupled to the first end of the sleeve so that the sleeve is movable with the armature. The armature includes an outer perimeter a second distance from the longitudinal axis, such that the second distance is not greater than the first distance.

The coil assembly may include an inner surface. An outer surface of the armature and the inner surface of the coil assembly may define a working gap less than 100 microns. The fuel injector may include a sealing member coupled to the second end of the sleeve. The sealing member may include a spherical shaped member to engage the sea. The spherical shaped member may be a ball or a needle. The outer surface of the sleeve and the outer perimeter of the armature may be circular. The armature may be disposed entirely within a volume defined by the outer surface of the sleeve extending along the longitudinal axis. The armature may include a stop portion defining the outer perimeter and contacting at least a portion of the first end of the sleeve. The sleeve and the armature may include at least one flow hole defining a fuel passage from the inlet to the outlet of the fuel injector. The flow hole in the armature may have an oval shape. The flow hole in the sleeve may be disposed on the second end of the sleeve. At least one flow hole in the sleeve may be disposed on a transition portion between the first and second ends. The armature and the sealing member may be coupled to the sleeve by a tack weld or a seam weld. The sleeve may be a stamped member or a thin-walled drawn member.

In another embodiment, the invention provides a method of defining a working gap of less than 100 microns in a fuel injector including an electromagnetic actuator having an inner surface, and a closure member having a longitudinal axis and operable by the electromagnetic actuator. The method includes providing the closure member with a sleeve and an armature coupled to the sleeve such that the sleeve provides a working surface for defining the working gap between an outer surface of the armature and the inner surface of the electromagnetic actuator. The sleeve is movable with the armature. The method includes establishing the working gap to be less than 100 microns. The armature may be disposed entirely within a volume defined by the working surface of the sleeve extending along the longitudinal axis.

In yet another embodiment, the invention provides a closure assembly for a fuel injector including a housing. The closure assembly includes an electromagnetic actuator disposed in the housing and having an inner surface. A closure member is disposed in the housing and is operable by the actuator to permit and prohibit fuel flow through the fuel injector. The closure member includes a sleeve extending along a longitudinal axis, the sleeve having an end and an outer surface. The closure member includes an armature coupled to the end of the sleeve and disposed entirely within a volume of the outer surface of the sleeve extending along the longitudinal axis.

In yet another embodiment, the invention provides a fuel injector having a housing including an inlet, an outlet, and a passageway for fuel flow from the inlet to the outlet along a longitudinal axis. A coil assembly is disposed proximate the inlet of the fuel injector, and has an inner surface surrounding the passageway about the longitudinal axis. A seat is disposed proximate the outlet of the fuel injector. A closure member is disposed in the housing and is operable by the coil assembly to permit and prohibit fuel flow through the seat. The closure member includes a non-magnetic sleeve having first and second sleeve ends extending along the axis, the non-magnetic sleeve having a fluid passage between the first and second sleeve ends. The closure member includes a magnetic armature having first and second armature ends. The first armature end includes an outer surface spaced apart from the inner surface of the coil assembly to provide a working gap between the outer surface and the inner surface. The second armature end is coupled to the first sleeve end so that the sleeve is movable with the armature. A sealing member is coupled to the second sleeve end. The non-magnetic sleeve may include an intermediate portion connecting the first and second sleeve ends. The intermediate portion may have apertures in communication with the fluid passage of the non-magnetic sleeve to permit fluid communication between the inlet and the sealing member.

In yet another embodiment, the invention provides a method of manufacturing a closure member for a fuel injector. The closure member includes an armature and a sleeve. The fuel injector includes a coil assembly having a surface disposed about a longitudinal axis of the fuel injector, the coil assembly surface defining a passageway. The closure member is operable by the coil assembly. The method includes forming the sleeve such that the sleeve includes an outer surface disposed about a longitudinal axis of the sleeve, the outer surface being a first distance from the sleeve longitudinal axis. The method includes forming the armature such that the armature includes an outer surface disposed about a longitudinal axis of the armature, the outer surface of the armature being a second distance from the armature longitudinal axis, the second distance being shorter than the first distance. The method includes coupling the armature to the sleeve so that the sleeve longitudinal axis is substantially colinear with the armature longitudinal axis.

The forming the sleeve may include forming a recess in a first end of the sleeve, and the coupling the armature to the sleeve may include press-fitting a first end of the armature into the recess of the sleeve. The outer surface of the sleeve may be calibrated to set a working gap between the outer surface of the armature and the coil surface. The coupling the armature to the sleeve may include spot welding, light swaging, radial laser welding, bonding, and spin-welding. The forming the sleeve may include forming the sleeve of a non-magnetic material and a non-magnetic metal material. The forming the armature may include powder metal forming. The forming the sleeve may include stamping and drawing. The forming the sleeve may include forming a portion of the sleeve disposed at a second end of the sleeve to include an outer surface that is a third distance from the sleeve longitudinal axis. The third distance may be shorter than the first distance. At least one aperture may be formed in the portion disposed at the second end of the sleeve.

In still another embodiment, the invention provides a method of setting a working gap in a fuel injector. The method includes manufacturing a closure member, and disposing a portion of the closure member within the coil assembly passageway such that the respective axis' of the fuel injector, the sleeve, and the armature are substantially colinear. The working gap is defined by the outer surface of the armature and the coil assembly surface.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention.

DETAILED DESCRIPTION OF THE PREFERRED EMBODIMENTS

Figure 1:
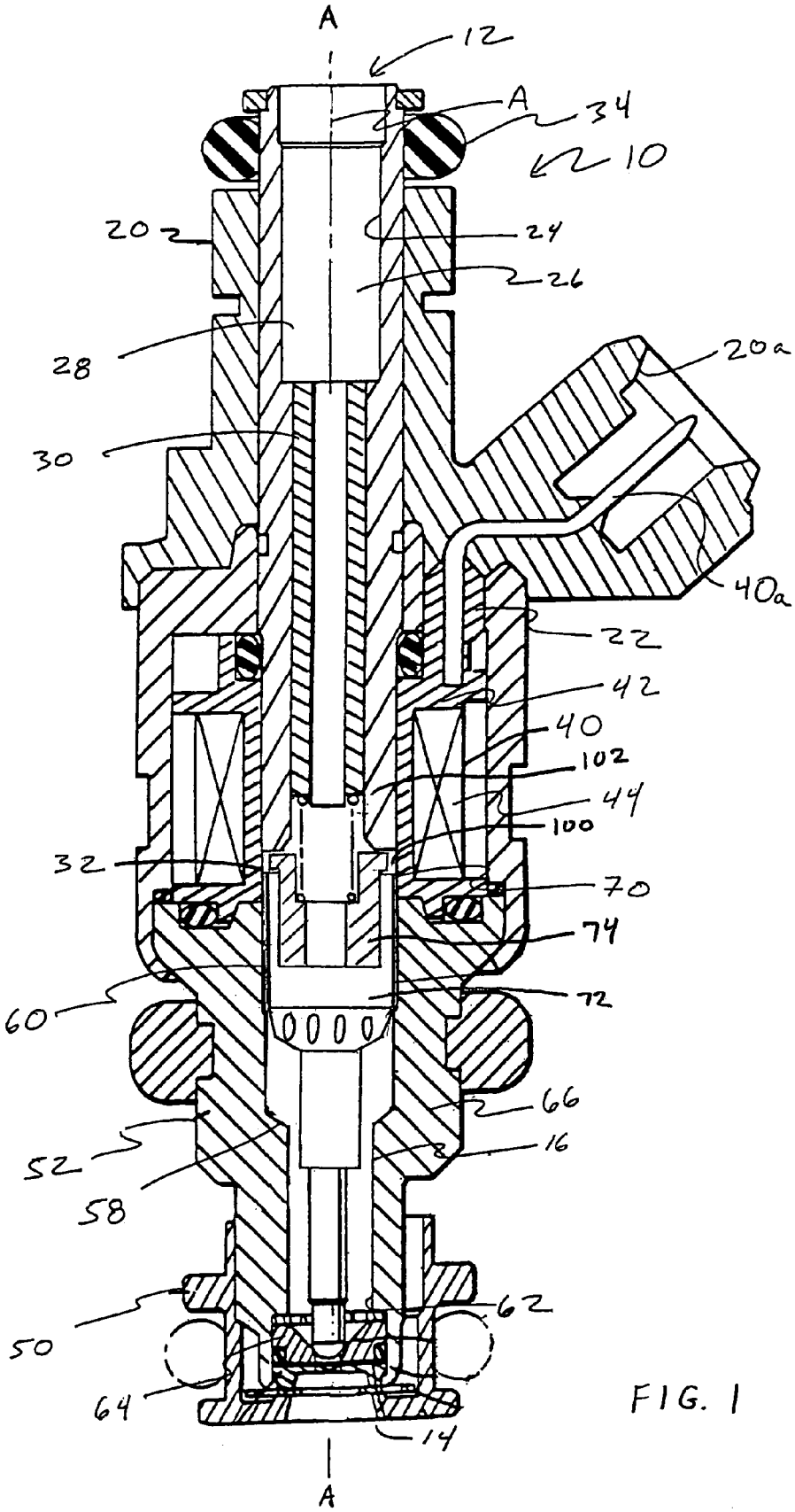
FIG. 1 is a partial cross-sectional view of a fuel injector assembly including a closure member, according to an embodiment of the invention.

FIG. 1 illustrates a fuel injector assembly 10 including a closure member 70, according to an embodiment of the invention. The fuel injector assembly 10 includes a housing having a fuel inlet 12, a fuel outlet 14, and a fuel passageway 16 extending from the fuel inlet 12 to the fuel outlet 14 along a longitudinal axis A-A. The housing includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector assembly 10. A fuel filter 28 and an adjustable tube 30 are provided in the inlet passage 26. The adjustable tube 30 is positionable along the longitudinal axis A-A before being secured in place, thereby varying the length of an armature bias spring 32. In combination with other factors, the length of the spring 32, and hence the bias force against the closure member 70, controls the quantity of fuel flow through the fuel injector assembly 10. The overmolded plastic member 20 also supports a socket 20*a* that receives a plug (not shown) to operatively connect the fuel injector assembly 10 to an external source of electrical potential, such as an electronic control unit (not shown). An elastomeric O-ring 34 is provided in a groove on an exterior of the inlet member 24 to sealingly secure the inlet member 24 to a fuel supply member (not shown), such as a fuel rail.

The fuel injector assembly 10 includes an electromagnetic actuator having a coil assembly 40. The coil assembly 40 includes a bobbin 42 that retains a coil 44. The ends of the coil 44 are electrically connected to pins 40*a* mounted within the socket 20*a* of the overmolded plastic member 20. The closure member 70 is supported for relative movement along the longitudinal axis A-A with respect to the inlet member 24. The closure member 70 is supported by a body shell 50 and a body 52. The body shell 50 engages the body 52. An axially extending body passage 58 connects the inlet portion 60 of the body 52 with an outlet portion 62 of the body 52. A seat 64, which is preferably formed of a metallic material, is mounted at the outlet portion 62 of the body 52. The body 52 includes a neck portion 66 that extends between the inlet portion 60 and the outlet portion 62. The neck portion 66 can be an annulus that surrounds a portion of the closure member 70.

Operative performance of the fuel injector assembly 10 is achieved by magnetically coupling the closure member 70 to a stator 102. Thus, the closure member 70 serves as part of the magnetic circuit formed with the coil assembly 40. The closure member 70 is responsive to an electromagnetic force generated by the coil assembly 40 for axially reciprocating the closure member 70 along the longitudinal axis A-A of the fuel injector assembly 10. Movement of the closure member 70 opens and closes the seat passage of the seat 64, which permits or inhibits, respectively, fuel from flowing through the fuel outlet 14 of the fuel injector assembly 10.

Fuel that is to be injected from the fuel injector 10 is communicated from a fuel inlet source (not shown), to the fuel inlet 12, through the fuel passageway 16, and exits from the fuel outlet 14. The fuel passageway 16 includes the inlet passage 26 of the inlet member 24, the body passage 58 of the body 52, and the seat passage of the seat 64.

While embodiments of the invention are described with reference to the fuel injector assembly 10 illustrated in FIG. 1, embodiments of the invention may be included with other fuel injector assemblies. For example, embodiments of the invention may be included with the fuel injector assemblies shown and described in U.S. Pat. No. 6,676,044, the entirety of which is incorporated by reference.

The closure member 70 is disposed in the fuel injector housing and is operable by the coil assembly 40 to permit and prohibit fuel flow through the seat passage of the seat 64. The closure member 70 includes a non-magnetic sleeve 72, a magnetic armature 74, and a sealing member 76.

Figure 3:
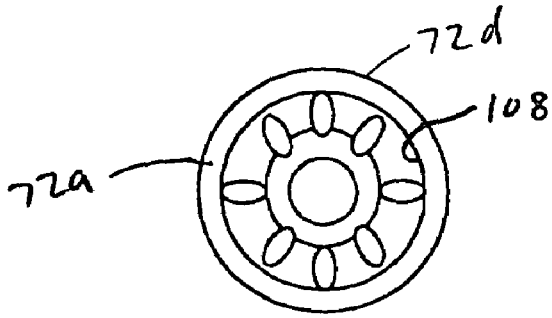
FIG. 3 is a top view of the sleeve of FIG. 2.
Figure 2:
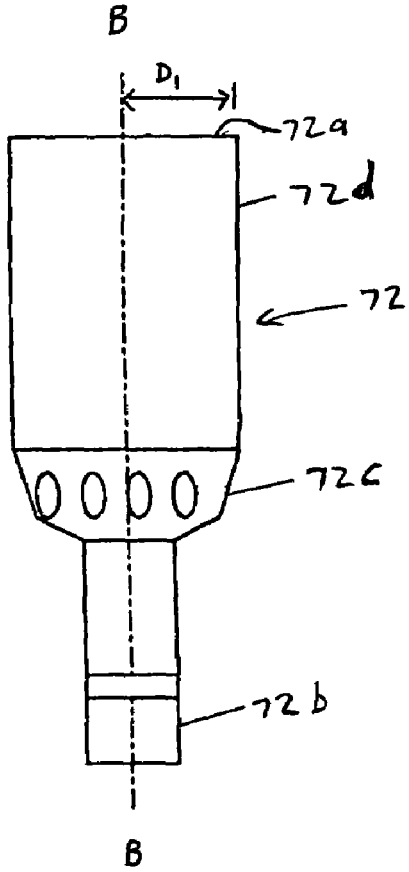
FIG. 2 is an elevation view of a sleeve, according to an embodiment of the invention.

As shown in FIG. 1, the sleeve 72 provides a working surface to set a radial working gap 100 between the exterior surface of the armature 74 and the interior surface of the coil assembly 40. Preferably, the radial working gap can be less than about 100 microns. As shown in FIGS. 2-3, the sleeve 72 is an annulus that extends along a longitudinal axis B-B, and includes a first end 72*a*, a second end 72*b*, and a transition portion 72*c* disposed therebetween, each having a different diameter. An outer surface 72*d* at a distance D1 from the longitudinal axis B-B provides the working surface. The longitudinal axis B-B of the sleeve 72 can be generally coaxial with the longitudinal axis A-A of the fuel injector assembly 10. Although the sleeve 72 is preferably a thin-walled member that can be formed by stamping and drawing, the sleeve 72 can be any member that includes a surface that cooperates with the interior surface of the coil assembly to set the radial working gap between the exterior surface of the armature and the interior surface of the coil assembly.

Figure 5:
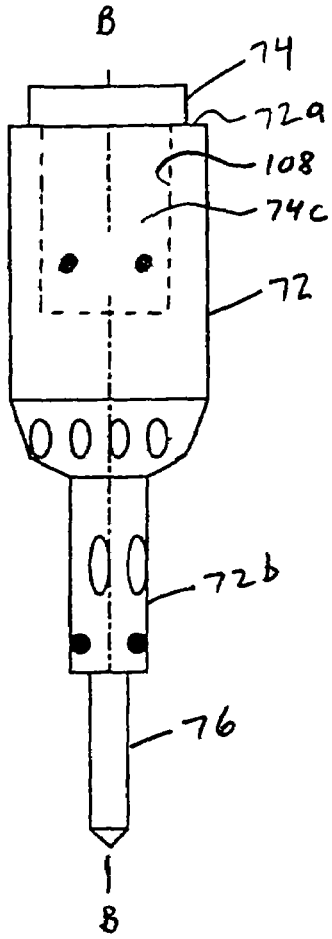
FIG. 5 is an elevation view of a closure member including a needle, according to an embodiment of the invention.
Figure 6:
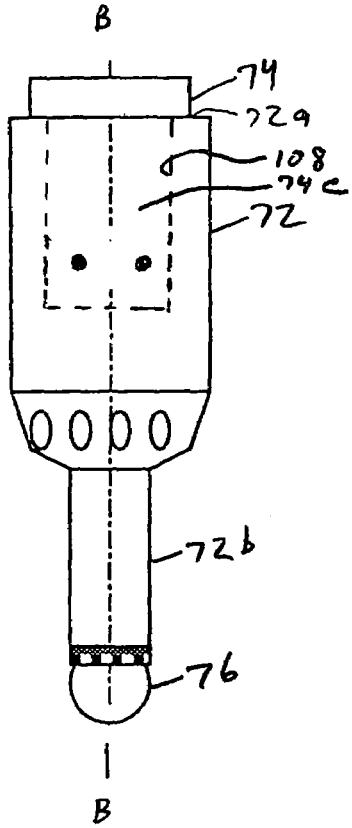
FIG. 6 is an elevation view of a closure member including a ball, according to an embodiment of the invention.

The armature 74 is coupled to the first end 72*a* of the sleeve 72. As shown in FIGS. 5 and 6, the armature 74 is coupled to the sleeve 72 by disposing at least a portion of the armature 74 in a recess 108 formed in the first end 72*a* of the sleeve 72, and securing the armature 74 to the sleeve 72. The lower portion 74*c* of the armature 74 preferably is press-fit into the recess 108 of the sleeve 72. In a pre-assembled condition, the working surface 72*d* of the sleeve 72 can be out of roundness with the longitudinal axis A-A of the fuel injector assembly 10, because the sleeve 72 can be properly shaped into roundness by the press-fit procedure. Preferably, a laser tack weld and/or seam weld can be used to couple the components. However, it is to be understood that the armature 74 can be coupled to the sleeve 72 by other methods, such as by light swage, radial laser welding, bonding, or spin welding.

Figure 4:
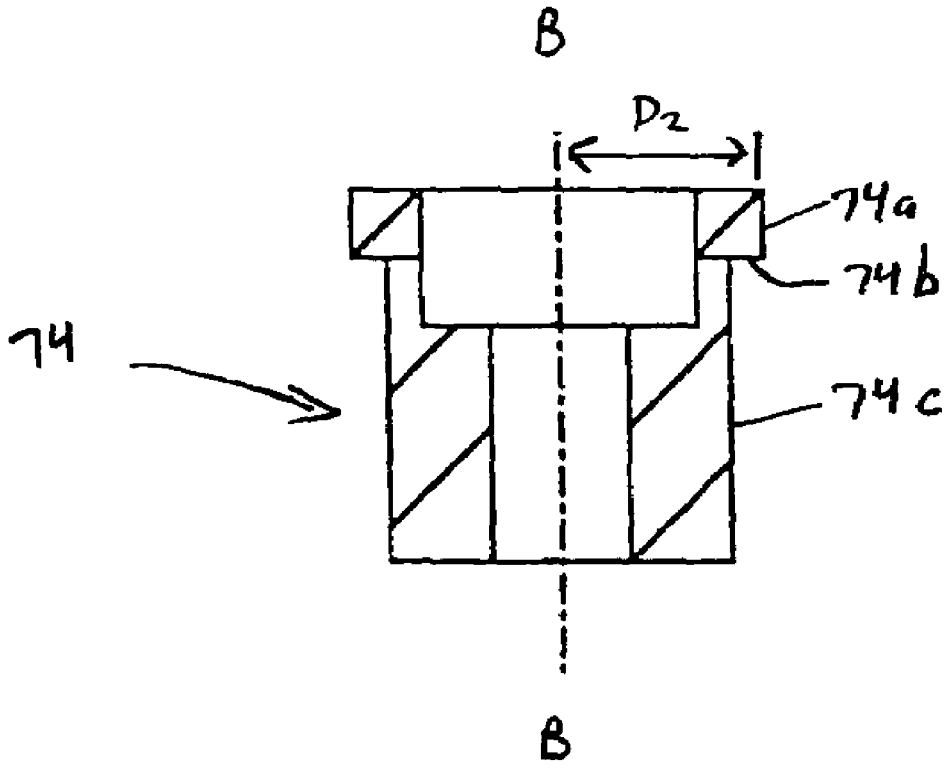
FIG. 4 is a cross-sectional view of an armature, according to an embodiment of the invention.

The armature 74 provides numerous advantages during assembly of the closure member 70. For example, the armature 74 does not need to be manufactured to tight tolerances, since the working surface that cooperates with the interior surface of the coil assembly to set the radial working gap between the exterior surface of the armature and the interior surface of the coil assembly is provided by the sleeve 72. Thus, the armature 74 may be manufactured to tolerances sufficient for coupling to the sleeve 72. Accordingly, the armature 74 may be produced as an unground component using methods such as sintering, powdering, metal injection molding, or other suitable metal forming operations that produce acceptable tolerances. Further, the armature 74 may be sized to provide desired operational characteristics of the coil assembly 40. For example, armature 74 may have a smaller mass than conventional armatures, thus providing shorter actuation response times. As illustrated in FIG. 4, the armature 74 includes an outer perimeter 74*a* at a distance D2 from the longitudinal axis B-B, such that the distance D2 is not greater than the distance D1. In a preferred embodiment, the outer perimeter 74*a* defines the radial working gap with the interior surface of the coil assembly. The armature 74 can include a stop portion 74*b* and a lower portion 74*c*. The stop portion 74*b* can include the outer perimeter 74*a*, and can contact at least a portion of the first end 72*a* of the sleeve 72.

Each of the sleeve 72 and the armature 74 can include at least one flow hole therethrough, the flow holes defining an internal fuel passage from the fuel inlet 12 to the fuel outlet 14 of the fuel injector assembly 10. In a preferred embodiment, the flow hole in the armature 74 has a circular shape. However, the flow hole can have other shapes, such as an oval shape. The at least one flow hole in the sleeve 72 can be disposed on the second end 72*b*, and can be disposed on the transition portion 72*c*. The at least one flow hole in the sleeve 72 can be formed during the stamping of the sleeve 72. Therefore, a variety of flow hole geometries can be easily formed to improve hot-gas injector performance and reduce turbulent flow effects. It is to be understood that when the sleeve 72 and armature 74 do not provide an internal fuel passage or flow path, fuel can flow from the fuel inlet 12 to the fuel outlet 14 by flowing around the closure member 70.

In the fuel injector assembly 10, it is known to generate the electromagnetic force for axially reciprocating the closure member 70 through energization of the coil assembly 40. The electromagnetic flux can flow from the interior surface of the coil assembly 40 to the closure member 70.

Figure 7:
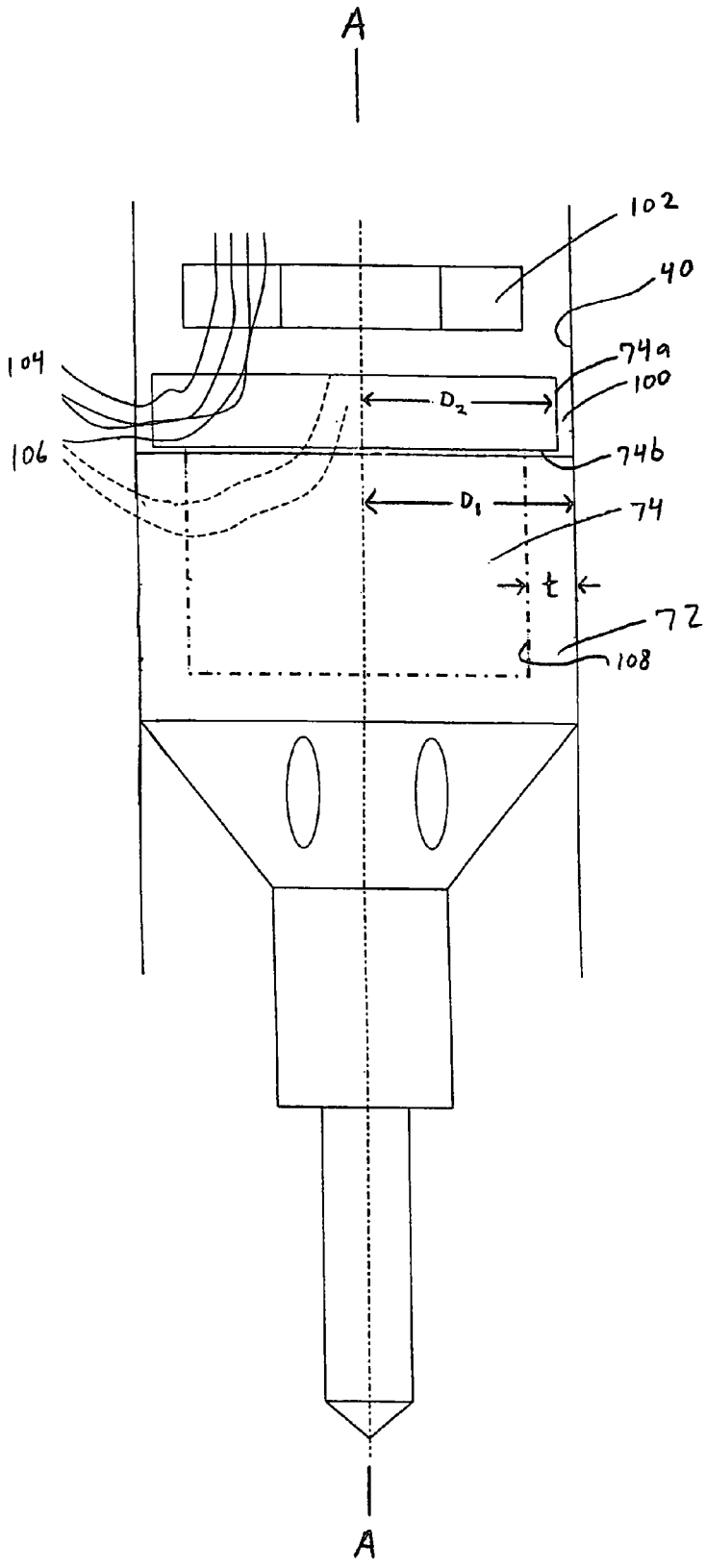
FIG. 7 is a schematic view of a magnetic flux path, according to an embodiment of the invention.

Referring to FIG. 7, magnetic flux flow paths 104 provide a flow of electromagnetic flux between the coil assembly 40, the magnetic armature 74, and the stator 102. The flow of electromagnetic flux is concentrated between the coil assembly 40 and the outer perimeter 74*a* of the magnetic armature 74 through the use of the non-magnetic sleeve 72. Because sleeve 72 is non-magnetic, and because a thickness "t" of the sleeve wall is greater than the radial length of the working gap 100, the flow of magnetic flux is "choked-off" and deterred from flowing through the non-magnetic sleeve 72. That is to say, the magnetic flux will follow the magnetic flux flow paths 104, rather than phantom magnetic flow paths 106. In this manner, operation of the coil assembly 40 to axially reciprocate closure member 70 may be improved due to faster magnetic saturation when energizing the coil assembly 40, and faster magnetic dissipation when de-energizing the coil assembly 40, as compared to a coil assembly that reciprocates a closure member without a sleeve.

The sealing member 76 can be disposed at an end of the closure member 70 to engage the seat 64, thereby permitting and preventing fuel flow from the fuel outlet 14 of the fuel injector assembly 10. As shown in FIGS. 5 and 6, the sealing member 76 is a separate member that is coupled to the sleeve 72. However, it is to be understood that the sealing member 76 can be integrally formed with the sleeve 72. For example, the sealing member 76 and the sleeve 72 can be stamped as one integral member. The sealing member 76 can be coupled to the sleeve 72 by disposing at least a portion of the sealing member 76 in the second end 72*b* of the sleeve and/or by any connection so long as relative movement of the sleeve 72 provides relative movement of the sealing member 76. The sealing member 76 can be a spherical shaped member, such as a ball, the sealing member 76 may be a needle member, or the sealing member 76 may be any member suitable for effecting a seal with seat 64.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A fuel injector having a housing including an inlet, an outlet, and a passageway for fuel flow from the inlet to the outlet, the fuel injector comprising:

a coil assembly disposed proximate the inlet of the fuel injector;

a seat disposed proximate the outlet of the fuel injector; and a closure member disposed in the housing and operable by the coil assembly to permit and prohibit fuel flow through the seat, the closure member including:

a sleeve extending along a longitudinal axis and having first and second ends, the sleeve including a recess and having an outer surface a first distance from the longitudinal axis; and an armature coupled to the first end of the sleeve so that the sleeve is movable with the armature, the armature having a first portion disposed in the recess of the sleeve and a second portion extending outwardly from the first end of the sleeve, the second portion having an outer perimeter a second distance from the longitudinal axis, the second distance not greater than the first distance.

2. The fuel injector according to claim 1, wherein the coil assembly comprises an inner surface, the outer perimeter of the second portion of the armature and the inner surface of the coil assembly defining a working gap less less than 100 microns.

3. The fuel injector according to claim 1, further comprising a sealing member coupled to the second end of the sleeve.

4. The fuel injector according to claim 1, wherein the sealing member comprises a spherical shaped member to engage the seat.

5. The fuel injector according to claim 4, wherein the spherical shaped member comprises a ball.

6. The fuel injector according to claim 1, wherein at least one of the outer surface of the sleeve and the outer perimeter of the armature is circular.

7. The fuel injector according to claim 1, wherein the armature includes a stop portion, the stop portion defining the outer perimeter and contacting at least a portion of the first end of the sleeve.

8. The fuel injector according to claim 1, wherein each of the sleeve and the armature includes at least one flow hole there through, the flow holes defining a fuel passage from the inlet to the outlet of the fuel injector.

9. The fuel injector according to claim 8, wherein the at least one flow hole in the armature comprises an oval shape.

10. The fuel injector according to claim 9, wherein the at least one flow hole in the sleeve is disposed on the second end of the sleeve.

11. The fuel injector according to claim 9, wherein the at least one flow hole in the sleeve is disposed on a transition portion between the first and second ends.

12. The fuel injector according to claim 3, wherein at least one of the armature and the sealing member are coupled to the sleeve by a tack weld.

13. The fuel injector according to claim 3, wherein at least one of the armature and the sealing member are coupled to the sleeve by a seam weld.

14. The fuel injector according to claim 1, wherein the sleeve comprises at least one of a stamped member or thin-walled drawn member.

* * * * *